US012274929B1

(12) United States Patent
Putman

(10) Patent No.: US 12,274,929 B1
(45) Date of Patent: Apr. 15, 2025

(54) SYSTEM AND METHOD USING INDICES ON A PUTTER HEAD TO ASSESS THE SLOPE OF A PUTTING SURFACE

(71) Applicant: Christopher D. Putman, Louisville, KY (US)

(72) Inventor: Christopher D. Putman, Louisville, KY (US)

( * ) Notice: Subject to any disclaimer, the term of this patent is extended or adjusted under 35 U.S.C. 154(b) by 0 days.

(21) Appl. No.: 18/733,172

(22) Filed: Jun. 4, 2024

(51) Int. Cl.
*A63B 53/04* (2015.01)
*A63B 69/36* (2006.01)

(52) U.S. Cl.
CPC ..... *A63B 69/3685* (2013.01); *A63B 53/0487* (2013.01); *A63B 2220/18* (2013.01)

(58) Field of Classification Search
CPC ..... A63B 53/0441; A63B 53/0487; A63B 69/3676; A63B 69/3685
See application file for complete search history.

(56) References Cited

U.S. PATENT DOCUMENTS 2,463,798 A * 3/1949 Paisley ..... A63B 24/0003 356/255
2,919,922 A * 1/1960 Skelly ..... A63B 69/3685 D21/737
2,976,046 A * 3/1961 McCullough, Jr. ..... A63B 69/3685 33/379
2,995,375 A * 8/1961 Bukovey ..... A63B 69/3685 33/379
3,306,618 A * 2/1967 Liljequist ..... A63B 53/0487 473/241
3,429,576 A * 2/1969 Ikeda ..... A63B 53/02 473/241
3,826,495 A * 7/1974 Elkins, Jr. ..... A63B 53/0487 473/409
4,082,286 A * 4/1978 La Breche ..... A63B 69/3685 473/241
4,174,839 A * 11/1979 Marrs ..... A63B 69/3685 473/252
4,291,883 A * 9/1981 Smart ..... A63B 69/3685 473/244
4,340,229 A * 7/1982 Stuff, Jr. ..... A63B 69/3685 473/250

(Continued)

FOREIGN PATENT DOCUMENTS

GB 2554482 A * 4/2018 ..... A63B 53/04

*Primary Examiner* — Alvin A Hunter
(74) *Attorney, Agent, or Firm* — The Rapacke Law Group, P.A.; Andrew Rapacke

(57) ABSTRACT

A system and method to assess the slope of a putting surface using indices on a putter head is disclosed. A putter having a putter head and a plurality of indices which are marked on the putter head is disclosed. Each of the indices correspond to a slope of the putting surface. The user stands on a 0% slope putting surface and identifies an object on the putting surface and holds the putter at a pivot point above the object to allow the putter head to move in a pendulum-style motion until it reaches a balanced position. The user then aligns their dominant eye vertically with the pivot point and the object to identify a zero point. The user may then move to a putting surface having a known variation in slope and repeat the process to mark the remaining indices corresponding to variations in slope. Alternatively, the user may use a template to mark the remaining indices.

12 Claims, 7 Drawing Sheets

(56) References Cited

U.S. PATENT DOCUMENTS 4,659,083 A * 4/1987 Szczepanski ..... A63B 69/3685 D21/745
4,795,157 A * 1/1989 Bencriscutto ..... A63B 69/3685 473/251
5,052,690 A * 10/1991 Sharp ..... A63B 69/3685 473/240
5,219,169 A * 6/1993 Martini ..... A63B 60/00 33/387
5,839,970 A * 11/1998 Lombardo ..... A63B 69/3685 351/239
6,659,882 B2 * 12/2003 Patsky ..... A63B 53/0466 473/409
6,663,496 B2 * 12/2003 Cameron ..... A63B 69/3614 473/473
6,837,799 B2 * 1/2005 Cameron ..... A63B 53/007 473/223
7,758,439 B2 * 7/2010 Roenick ..... A63B 60/00 473/238
7,905,792 B1 * 3/2011 Stites ..... A63B 53/0487 473/238
8,075,416 B2 * 12/2011 Stites ..... A63B 53/04 473/238
8,506,422 B2 * 8/2013 Monteiro ..... A63B 53/0487 473/340
2003/0109323 A1 * 6/2003 Edel ..... A63B 60/42 473/226
2004/0092328 A1 * 5/2004 Patsky ..... A63B 53/047 473/324
2006/0287130 A1 * 12/2006 Allen ..... A63B 53/0487 473/340
2007/0149309 A1 * 6/2007 Ford ..... A63B 60/52 473/328
2009/0118035 A1 * 5/2009 Roenick ..... A63B 60/00 473/340
2010/0062870 A1 * 3/2010 Pouliot ..... A63B 53/007 473/340
2010/0075775 A1 * 3/2010 Silvestre Monteiro ..... A63B 53/0487 473/340
2010/0317451 A1 * 12/2010 Stites ..... A63B 53/0487 473/257
2014/0315653 A1 * 10/2014 Wong ..... A63B 57/00 473/409
2015/0119160 A1 * 4/2015 Franklin ..... A63B 69/3685 473/251
2017/0036094 A1 * 2/2017 Kim ..... A63B 53/007
2023/0405417 A1 * 12/2023 Greaney ..... A63B 53/023

* cited by examiner

SYSTEM AND METHOD USING INDICES ON A PUTTER HEAD TO ASSESS THE SLOPE OF A PUTTING SURFACE

TECHNICAL FIELD

The embodiments disclosed herein generally relate to putting aiming systems and more particularly to systems and methods for analyzing the slope of a putting green.

BACKGROUND

Golf is a popular pastime in which players use various clubs to hit a ball into a series of holes on a golf course in as few strokes as possible. Putting is a very important component of the game. When putting, the golfer must determine the correct line of travel of the golf ball to the intended target (i.e., the hole). Before putting, the golfer will analyze the distance of the putt as well as the slope of the green in the direction which they are putting. Errors in the analysis of the putt often result in a missed putt, and thus an increase in the golfer's score. Because the putter is often the most used club throughout the round, the decrease in errors while putting is crucial to reducing the overall score of the round.

The process of analyzing the slope, speed, and other factors of a putting green is known as "green reading" and the process can be referred to as "reading the green". Many methods exist for reading the green, however, each method has the same goal of determining a putting line and pace which results in the golf ball going in the hole. In particular, it is crucial for golfers to accurately read the slope of the green at various points along the path the golf ball travels after being putted by the golfer. Often, golfers will simply use intuition, eyesight, and other cerebral measurements from their basic knowledge of physics, or simple slope analysis to determine an optimal start line of the putt.

Devices have been created to analyze the slope of the green, including levels placed on the putting surface or incorporated into the golf club which have indices to measure the slope of the green. While effective, these devices are not permitted for use by most governing bodies which control the rules of golf and especially golf tournaments.

Other techniques which are allowed by most governing bodies of golf and golf tournaments include feeling the slope with a golfer's feet which the golfer stands perpendicular to the ground along the line of the putt and determines the difference in pressure felt in his feet on different slopes. Also, "plumb bobbing" in which the golfer holds the putter and analyzes how the putter pivots about a pivot point (e.g., the hand or fingers holding the grip of the putter). If performed correctly, gravity holds the shaft and putter head in a vertical orientation and the golfer will analyze the angle of the putter in reference to their body position or in reference to a line between a point on the surface and the hole. In each case, the body position is preferably aligned perpendicular to the slope of the green.

SUMMARY OF THE INVENTION

This summary is provided to introduce a variety of concepts in a simplified form that is further disclosed in the detailed description of the embodiments. This summary is not intended for determining the scope of the claimed subject matter.

The embodiments provided herein relate to a system and method to assess the slope of a putting surface using indices on a putter head is disclosed. A putter having a putter head and a plurality of indices which are marked on the putter head is disclosed. Each of the indices correspond to a slope of the putting surface. The user stands on a 0% slope putting surface and identifies an object on the putting surface and holds the putter at a pivot point above the object to allow the putter head to move in a pendulum-style motion until it reaches a balanced position. The user then aligns their dominant eye vertically with the pivot point and the object to identify and mark a zero point. The user may then move to a putting surface having a known variation in slope and repeat the process to mark the remaining indices corresponding to variations in slope.

The embodiments provide an efficient and accurate method for identifying the slope of the putting surface, while providing a putter which conforms to current United States Golf Association (USGA) rules and regulations. The system and method can be used for various known putter styles and configurations by following the steps provided herein.

Previous methods require the user to use course knowledge, intuition, and rudimentary methods for assessing the slope of a putting surface. While some can master the skill of green reading, many find it difficult especially under pressure, in inclement weather and/or in variable light conditions. Systems such as AimPoint® can be difficult for players to master and implement, especially those who do not play and utilize the system consistently. Further, the AimPoint® system can require a significant amount of time to gather the appropriate data and implement when putting, thus decreasing the pace-of-play.

In one aspect, the plurality of indices are applied using semi-permanent or permanent application methods. The indices, once applied, are non-moveable and can be used repeatedly throughout rounds of golf to assess the slope of the putting surface.

In one aspect, the plurality of indices correspond to a slope one of the following: 1% slope, a 2% slope, a 3% slope, a 4% slope, and a 5% slope, wherein each of the 1% slope, a 2% slope, a 3% slope, a 4% slope, and a 5% slope is used to indicate a positive and a negative slope. While the above percentages are used by way of example, it is to be understood that the indices may be used to identify various other slope percentages and fractional portions thereof. It is to be understood that the slope angle can be measured in degrees rather than percent slope. However, percent slope is more commonly used in golf. The indices may be provided on any surface of the putter in accordance with the teachings provided herein. The indices may be oriented such that the indices progress towards the heal, toe, etc.

In one aspect, a template may be used to apply the plurality of indices. The template includes a plurality of marking measurements which correspond to the various slopes of a putting surface. The template is used as a measuring and marking device to accurately apply the indices to the putter head. During use, the user may position the template on top of or adjacent to the putter head to apply the indices which correspond to the linear marking measurements on the template.

A method for assessing the slope of the putting surface is provided. First, the user selects an object, or manually places on object which is positioned equidistant between the users left and right feet on a level, 0% slope surface. The user then holds the putter by the handle to establish a pivot point to allow the putter head to pivot in a pendulum-style motion until the putter head comes to rest at a balance point. The user then vertically aligns their dominant eye with the pivot point and object to establish a zero point on the putter head which is defined as the point on the putter head which is vertically aligned with the dominant eye, pivot point, and object. The zero point is marked using the applicator. The user may then stand on known putting slopes and repeat the above process to mark the various indices on the putter head. This process can be performed more quickly using a template. However, the template is not necessary to use and is provided as an alternative embodiment. In some instances, a laser may be used rather than the line-of-sight from a human.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1A:
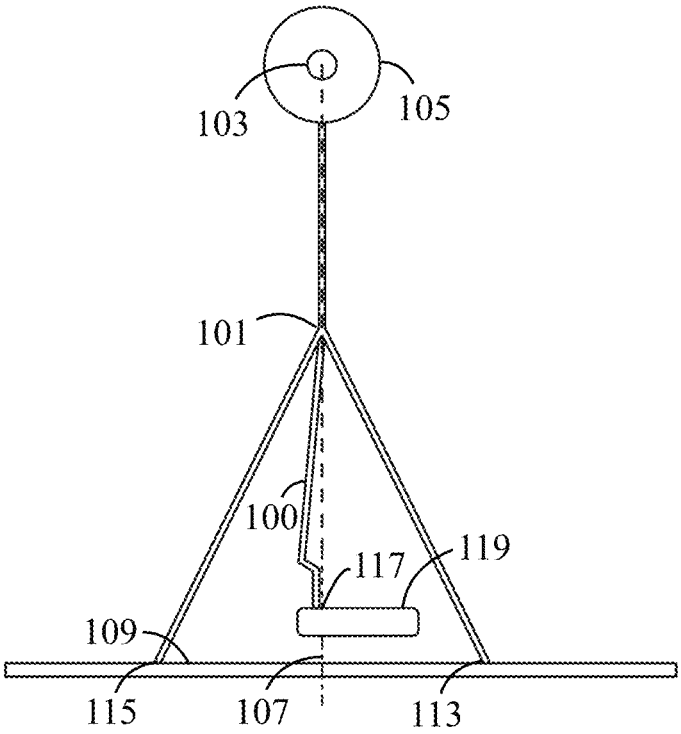
FIG. 1A illustrates a schematic of a user determining a zero point on the putter head using the processes described below, according to some embodiments.

The specific details of the single embodiment or variety of embodiments described herein are set forth in this application. Any specific details of the embodiments described herein are used for demonstration purposes only, and no unnecessary limitation(s) or inference(s) are to be understood or imputed therefrom.

Before describing in detail exemplary embodiments, it is noted that the embodiments reside primarily in combinations of components related to particular devices and systems. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments provided herein relate to a system and method for marking a putter head to assess the slope of a putting surface. The markings on the putter head may be used as indices to allow the user to efficiently assess the slope of the putting surface, and thus implement an aiming system using the indices on the putter head. The system can be readily applied to various putter configurations.

The embodiments seek to provide the golfer (also referred to herein as "user" or "the user") with a quick and accurate means by which to assess the slope of the green along the line of his/her putt. This slope assessment can be combined with other methods to quickly, reliably, and accurately determine an intended starting direction of the putt while conforming to United States Golf Association (USGA) rules and regulations.

As used herein, the term "object" is used to define any point which is used by the user to aid in defining the indices and specifically the zero point on the putter head. For example, the "object" could be a grain of sand or blade of grass.

As used herein, the term "zero point" is used to define a location on the putter head which aligns with the dominant eye of the user and the object positioned on the putting surface when the putter is held at the pivot point above the object and the user is standing on a 0% slope surface. This process is described and illustrated by FIG. 2A.

While the use of the term "putting surface" is used herein, it is to be understood that the process may be performed on any surface upon which the user may stand. For example, the user may perform the process of marking the putter at home, especially when performing the process of establishing the zero point.

As used herein, the term "balance point" is used to define the position at which the putter comes to rest while being held at the pivot point. The balance point is used in each step of the process as the user stands on putting surfaces having various slopes.

As used herein, the term "pivot point" is used to define the location on the putter being held by the user. Often, the user will use their fingers to apply pressure at a defined location on the handle or shaft of the putter. The pivot point may be changed based on the length of the putter, shaft configuration, shaft material, balance point of the putter, configuration of the putter head, style of grip, or other putter characteristics known in the arts.

In some embodiments, the user may utilize a mechanical means of holding the putter, such as a clamp or other device which can hold the putter handle.

Figure 1B:
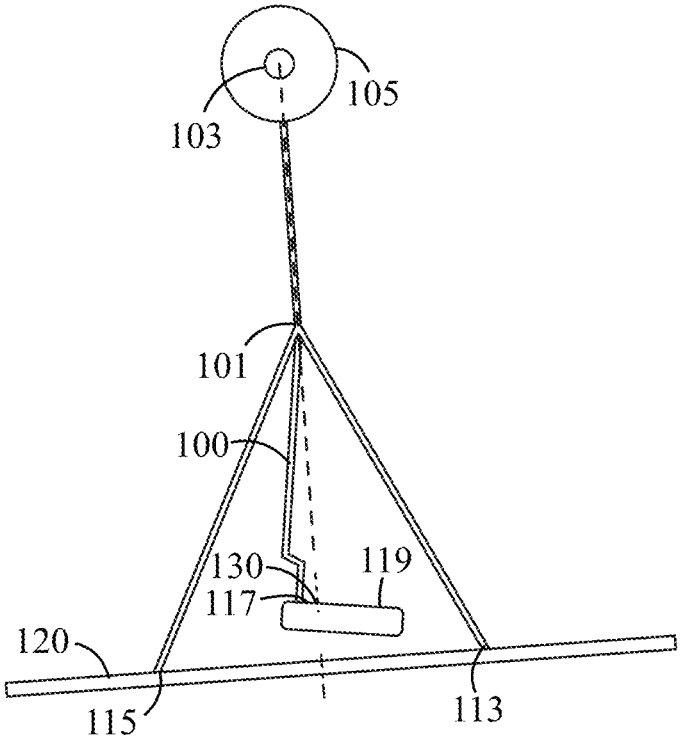
FIG. 1B illustrates a schematic of a user assessing the slope of a putting surface and determining the position of a plurality of slope markings on the putter head using the processes described below, according to some embodiments.

In some embodiments, the indices position on the putter head may be calculated using the formula: (length of zero mark to X % indices)=tan (X %/100)*(length of pivot point to putter head). In such, the spacing of the indices on the putter head is standardized based on the aforementioned equation. FIGS. 1A and 1B illustrates a schematic of a user determining a zero point on the putter head using the processes described below. In particular, FIG. 1A illustrates the putter 100 being held at a pivot point 101 (such as the handle). The dominant eye 103 of the user 105 is aligned with an object 107 found or positioned on the non-sloping putting surface 109. The user 105 first stands on a non-sloping putting surface 109 (i.e., a surface having a 0% slope) with their fingers holding the grip of the putter 100. The object 107 is to be positioned equidistant of the left and right feet 113,115 of the user 105 while the dominant eye 103 is positioned in vertical alignment with the object 107. A zero point 117 may then be marked on the putter head 119 at the location wherein the object 107, zero point 117 and dominant eye 103 vertically align.

One skilled in the arts will readily understand that the indices may be provided on either side of the putter head (i.e., the putter face, or the rear side of the putter which opposes the face in the example of a blade-style putter). Other putter styles may allow for indices to be provided on various sides and surfaces of the putter in accordance with the teachings provided herein.

In some embodiments, the indices may be objectively or subjectively marked onto the putter. While embodiments are described wherein the indices are specifically calculated and marked, one skilled in the arts will readily understand that the indices may be marked using manual means which are not defined by mathematical concepts.

FIG. 1B illustrates a schematic of a user 105 assessing the slope of a sloped putting surface 120 and determining the position of a plurality of slope markings on the putter head 119. In contrast to FIG. 1A, the user in FIG. 1B is standing on a sloped putting surface 120 which allows the user to accurately mark an indicia corresponding to the slope of the putting surface. When standing on a sloped putting surface 120, the putter head will naturally (through the forces of gravity) pivot towards the downhill side when the putter is held above the sloped putting surface. The more slope that the putting surface has, the further the putter head will pivot, allowing the user to mark a plurality of indices on the putter head which correspond to various known slope angles of the putting surface.

In FIG. 1B, the balance point 130 of the putter head 119 has shifted away from the zero point 117. The new balance point 130 may be used to mark the indices on the putter which correspond to the slope of the sloped putting surface 120.

In some embodiments, the zero point may be assessed using an apparatus which holds the putter and allows the putter to move in a pendulum-style motion. This allows the putter to reach a balance point over a 0% slope surface. A plumb laser is arranged to intersect the pivot point and the zero point on the top of the putter head. As the surface is sloped in one direction, the indices can be marked on the putter head. In an alternative example, the placement of the indices can be calculated using the formula: (length of zero mark to X % indices)=tan (X %/100)*(length of pivot point to putter head).

In some embodiments, to establish a value for each of the indices on the putter head, the user may either use a putting surface having a known slope or may construct a surface which has a known slope. For example, the user may use a surface which can be systematically altered to have various slopes (e.g., 1°,2°,3°, etc.). This method may provide an accurate means of marking the putter head such that each of the indices corresponds to an accurate slope measurement. This process may also be performed using technical equipment utilized by the manufacturer of the putter. In another example, the user may simply estimate the slope of a putting surface using a digital, laser, and/or various types of mechanical levels (i.e., bubble levels, water levels, etc.).

Holding the putter in the described manner allows the putter head to move in a pendulum fashion above the ground (i.e., the putting surface). The pendulum movement of the putter head occurs as the user moves from a flat (i.e., a non-sloped) putting surface to a sloped putting surface, causing the putter head to pivot due to the force of gravity.

Figure 2A:
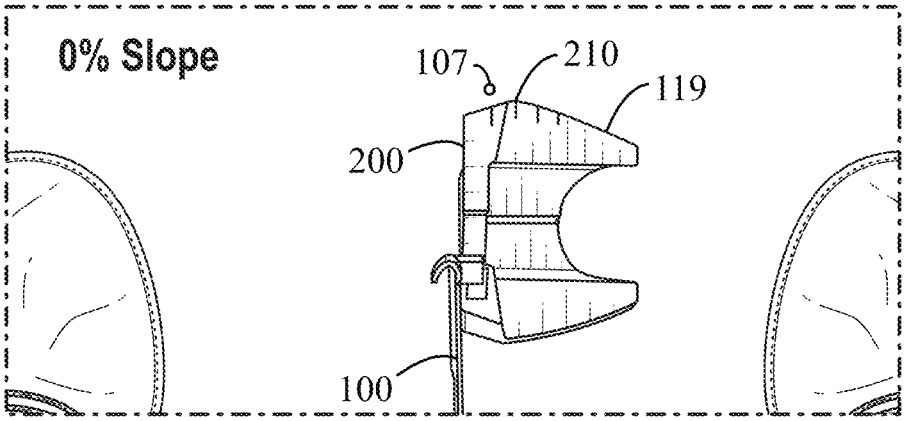
FIG. 2A illustrates a cutaway view of the putter head and indices wherein the putter head is being held above the zero point while the user is standing on a 0° slope as measured by the indices on the putter head, according to some embodiments.
Figure 2B:
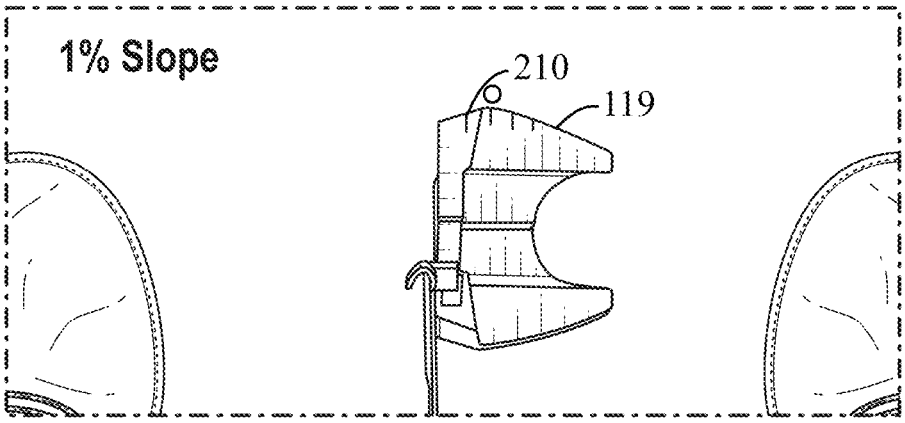
FIG. 2B illustrates a cutaway view of the putter head and indices wherein the putter head is being held above the zero point while the user is standing on a 1° slope as measured by the indices on the putter head, according to some embodiments.
Figure 2C:
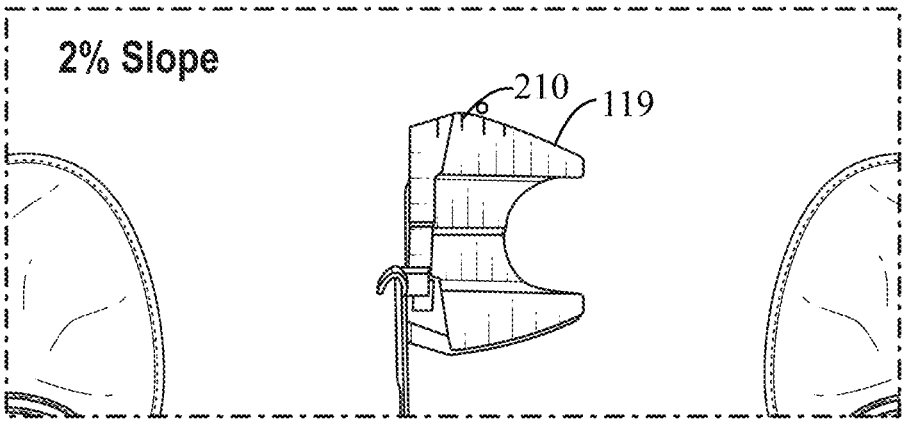
FIG. 2C illustrates a cutaway view of the putter head and indices wherein the putter head is being held above the zero point while the user is standing on a 2° slope as measured by the indices on the putter head, according to some embodiments.
Figure 2D:
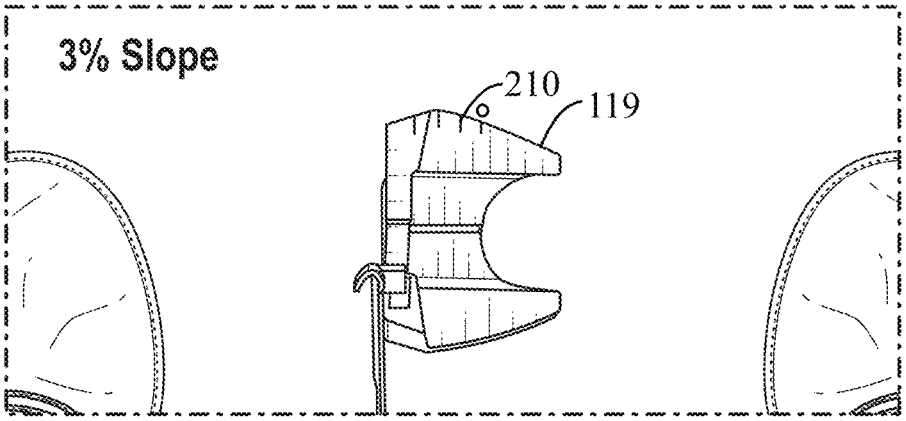
FIG. 2D illustrates a cutaway view of the putter head and indices wherein the putter head is being held above the zero point while the user is standing on a 3° slope as measured by the indices on the putter head, according to some embodiments.
Figure 2E:
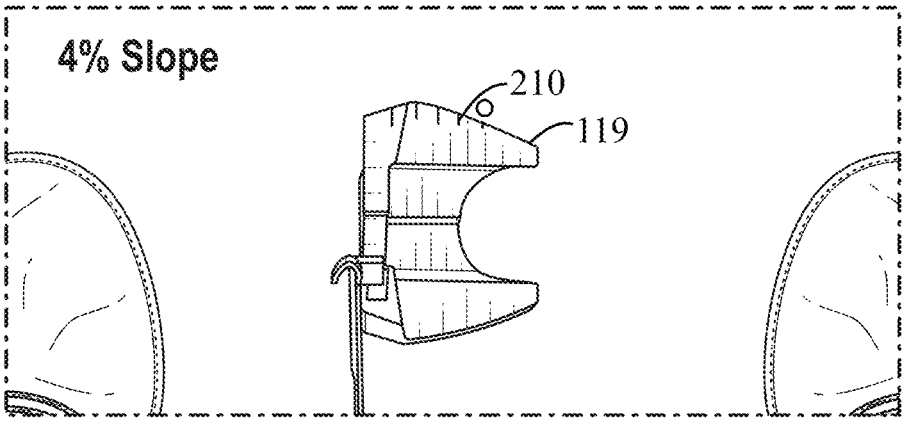
FIG. 2E illustrates a cutaway view of the putter head and indices wherein the putter head is being held above the zero point while the user is standing on a 4° slope as measured by the indices on the putter head, according to some embodiments.

FIGS. 2A-2E illustrate the putter head 119 and indices 210 wherein the putter head is being held above the zero point while the user is standing on various slopes. In particular, FIG. 2A shows a putting surface having a 0% slope. The object 107 in the illustrated example is shown having a vertical alignment with the indices 210 immediately right of the putter face 200 of the putter 100. While the illustrated example shows the zero point being positioned at the first indices immediately right of the putter face 200, the balance of the putter, configuration of the shaft, and other factors may cause the zero point to differ for each putter. In such, it is important that the user follows the steps for establishing the zero point as described herein.

FIG. 2B-2E illustrates the putter head 119 and indices 210 wherein the object is aligned at a indices which is not at the zero point. FIGS. 2A-2E illustrate how the putter head 119 pivots in a pendulum motion as the slope of the putting surface changes. The user may then utilize the indices 210 to determine the slope of the putting surface and, in conjunction with other methods, determine a starting line for their putt (or general path that they intend the ball to travel along throughout the putt) using the assessed angle.

Figure 3A:
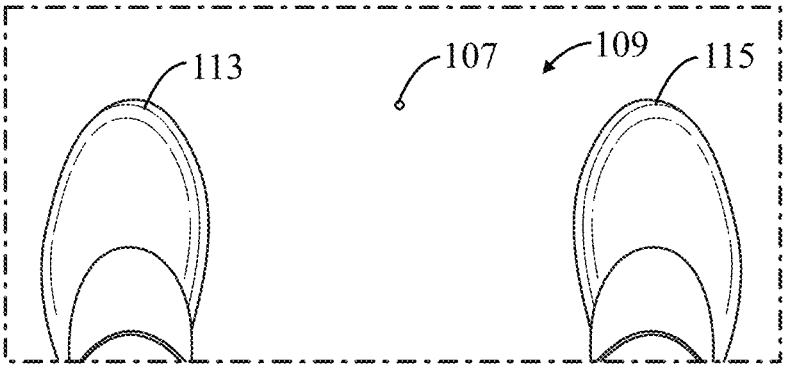
FIG. 3A illustrates a perspective view of a step of the process for marking the putter head, wherein the user has identified an object on the putting surface, according to some embodiments.
Figure 3B:
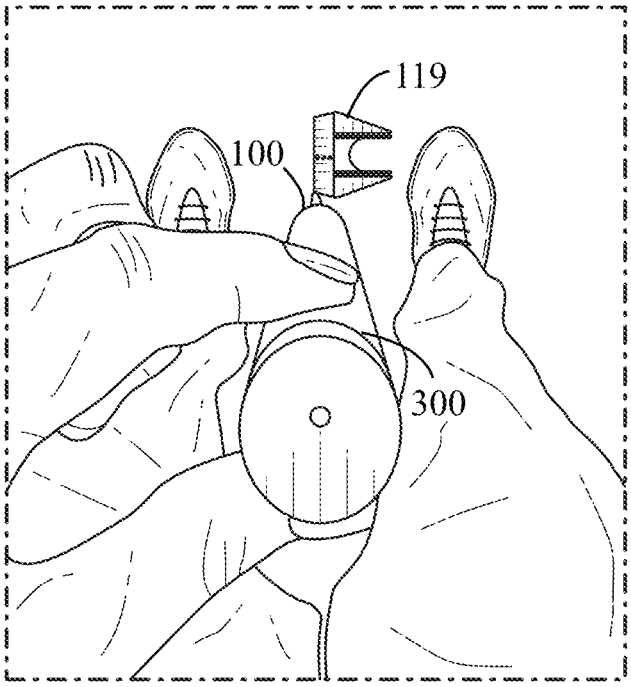
FIG. 3B illustrates a perspective view of a step of the process for marking the putter head, wherein the user is holding the putter handle such that the putter head is raised above the ground and the putter may pivot about the point at which the user is holding the putter handle, according to some embodiments.
Figure 3C:
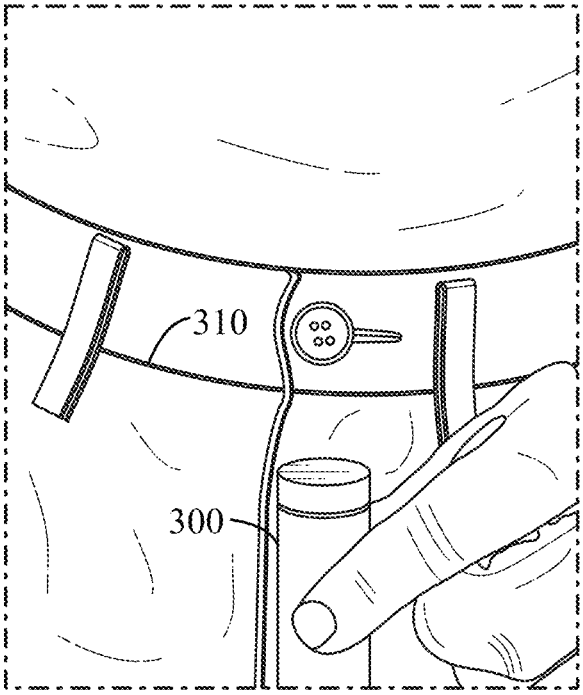
FIG. 3C illustrates a perspective view of a step of the process for marking the putter head, wherein the user is holding the putter handle at the centerline of his/her body such that the putter head is raised above the ground and the putter may pivot about the point at which the user is holding the putter handle, according to some embodiments.

FIG. 3A illustrates a step of the process for marking the putter head, wherein the user has identified an object 107 on the non-sloping putting surface 109. The object is positioned equidistant to the user's feet 113,115. It is to be understood that the object may be a naturally occurring object found on the putting surface or may be manually placed by the user (such as by using a tee, ball marker, or other item). Once the object 107 has been identified and the feet are properly positioned equidistant to the object, the user then holds the putter 100 at a pivot point such that the putter head 119 is suspended above the object (as shown in FIG. 3B). In particular, FIG. 3B shows the user holding the handle 300 using their fingers to allow the putter head to pivot in a pendulum-style motion based on the slope of the putting surface. FIG. 3C shows the user holding the handle 300 on the centerline of their body near their waist 310 which may be sufficient to suspend the putter head above the object. (However, it is to be understood that the length of the shaft of the putter is important when determining an appropriate pivot point to hold the putter. For example, longer putter shafts may require that the user hold the putter at a higher point (or simply hold the putter below the handle).

In general, the putter head is held at a minimal distance above the putting surface to retain accuracy when performing the task of marking the putter head or assessing the slope. To retain accuracy, the putter head is held at a minimal distance above the putting surface.

Figure 3D:
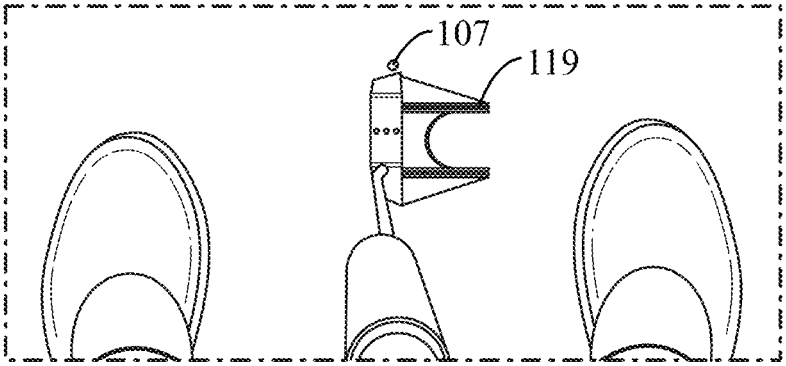
FIG. 3D illustrates a perspective view of a step of the process for marking the putter head, wherein the user is holding the putter head above the object to visually align the the object with a point on the putter head, according to some embodiments.
Figure 3E:
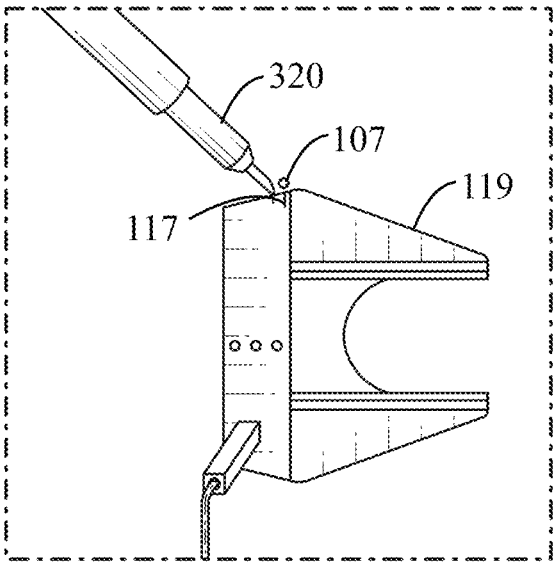
FIG. 3E illustrates a perspective view of a step of the process for marking the putter head, wherein the user is holding the putter head above the object to visually align a point on the putter head with the object and is marking the putter head to provide indices corresponding to the slope of the putting surface, according to some embodiments.

FIG. 3D illustrates a step of the process for marking the putter head, wherein the user is holding the putter head 119 above the object 107 to vertically align the putter head with the object and balance point. To accomplish this, the user will allow the putter head 119 to rest at the balance point to establish a zero point on the putter head 119. The user may then (as shown in FIG. 3E) mark the putter head 119 using an applicator 320 (such as a semi-permanent marker or sticker or paint, a permanent groove, engraving, or protrusion, or other marking). It is to be understood that the zero point 117 may change based on various putter characteristics and that its location shown in FIG. 3E is used for exemplary purposes.

The applicator 320 may be a marker used to apply an ink or other marking on the putter head. However, the applicator 320 may be defined as any means of applying the indices to the putter head (e.g., a sticker, engraving, protrusion, etc.).

Figure 3F:
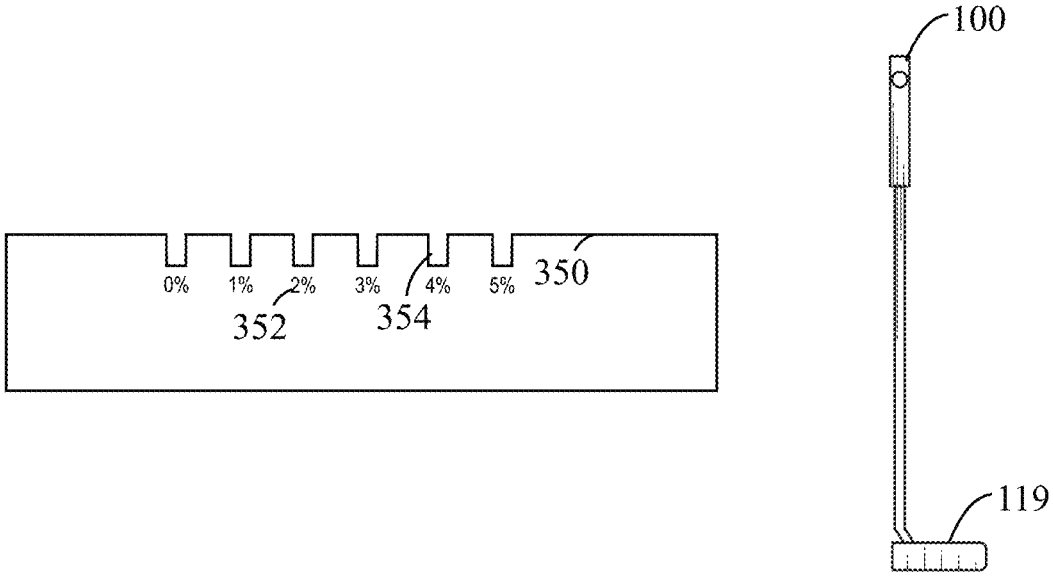
FIG. 3F illustrates a top plan view of an exemplary template and side elevation view of a putter, according to some embodiments.
Figure 3G:
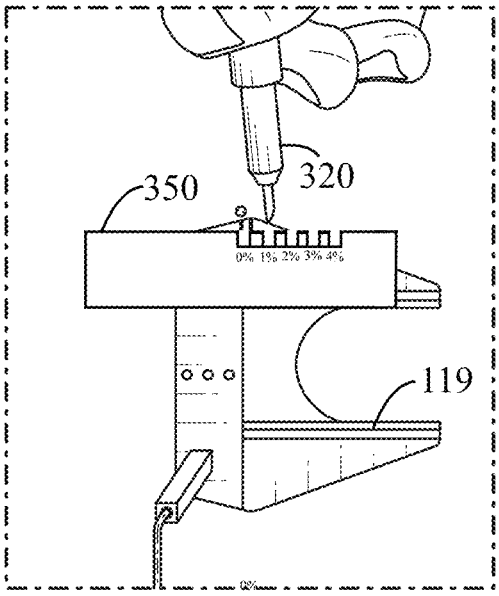
FIG. 3G illustrates a perspective view of the user marking the putter head using the template, according to some embodiments.

FIG. 3F illustrates the template 350 and putter 100. The template 350 may be any measuring device and may take the form of a tape measure, ruler, or similar implement. The template includes various linear measurement markings 352 which may correspond to a slope measurement. One skilled in the arts will readily understand that the linear measurement illustrated in FIG. 3F may be adjusted based on the user's needs and are non-limiting in scope. FIG. 3G illustrates the user marking the putter head 119 using the applicator 320 and template 350.

FIGS. 3A-3F are illustrated from the user's dominant eye perspective, showing the view the user would have when implementing the steps of the process described herein.

In some embodiments, the template 350 may include a plurality of openings 354 which allow the user to easily mark the putter using the applicator.

In some embodiments, the template 350 may not include the openings and may simply include reference lines which corresponds to the linear measurement markings to allows the user to accurately mark the putter head. More simple embodiments may not include reference lines and may only display the linear measurement markings.

In some embodiments, the template 350 may include an adhesive to retain the template 350 on the putter head 119. In other embodiments, the template 350 does not include an adhesive, allowing the user to position the template 350 in a suitable position and move the template 350 if needed. It is to be understood that while the illustrates show the template 350 being positioned on top of the putter head 119, the template may be positioned to the side of the putter. The template 350 is easily manipulated by the user such that it can be positioned suitably for marking various styles of putters including mallet-style, blade-style, and other styles of putters known in the arts.

Figure 4:
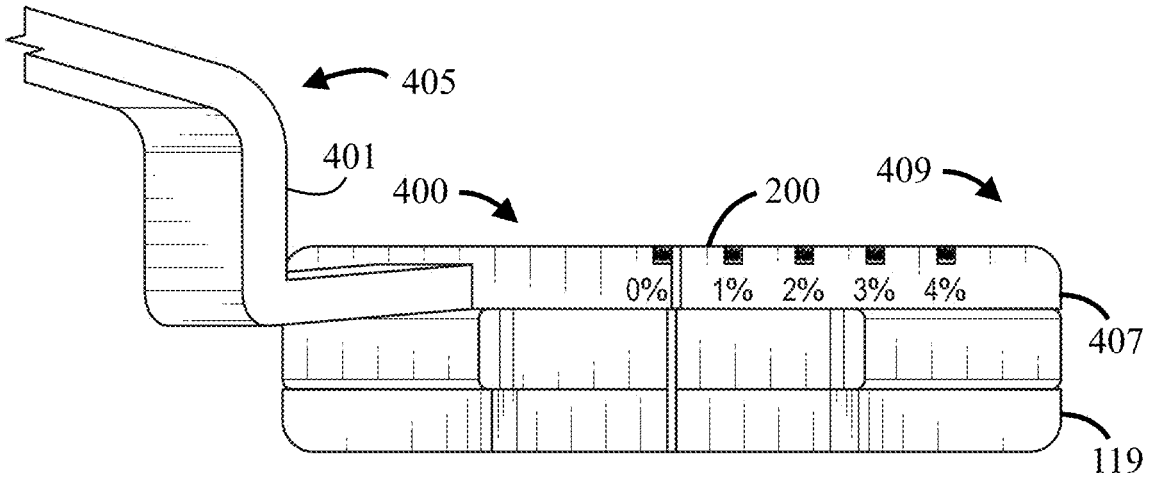
FIG. 4 illustrates a cutaway view of a blade-style putter having the indices for assessing the slope of the putting surface, according to some embodiments.
Figure 5:
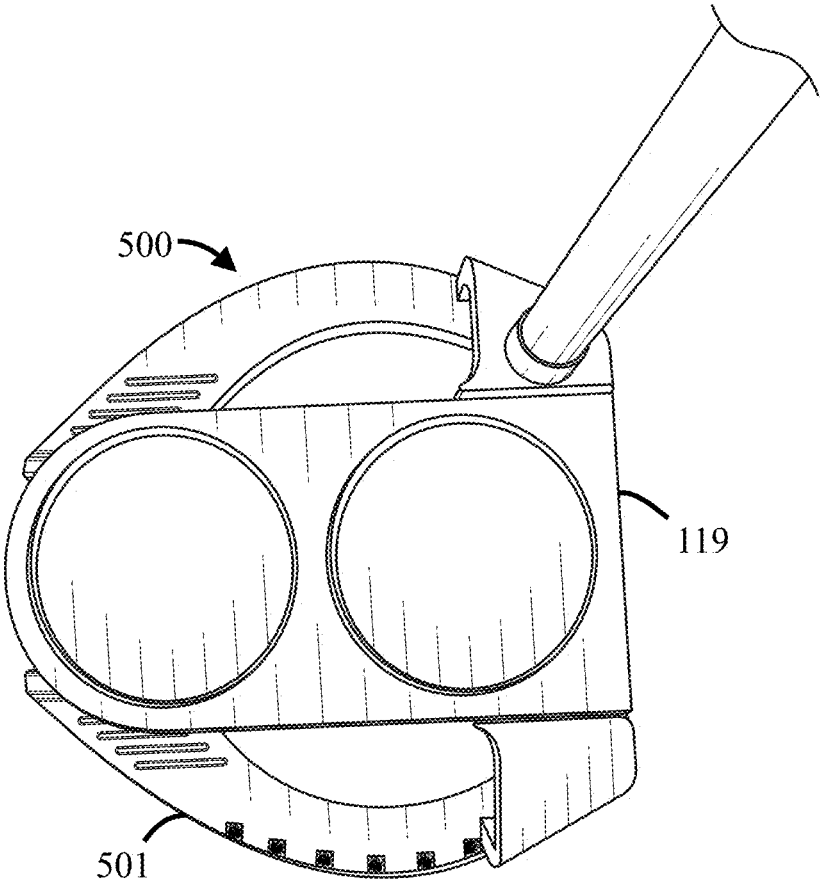
FIG. 5 illustrates a cutaway view of a curved mallet-style putter having the indices for assessing the slope of the putting surface, according to some embodiments.

FIG. 4 illustrates a perspective view of a blade-style putter having the indices for assessing the slope of the putting surface. Regardless of the putter's size, configuration, shape, or other characteristics, the system and methods described above may be implemented. When using a blade-style putter 400 as illustrated in FIG. 4, the user will turn the putter head such that the hosel 401 is oriented towards the downhill side 405 of the slope of the putting surface and the tip 407 is oriented towards the uphill side 409 of the putting surface. This orientation allows the user to mark indices on the top surface of the putter head 119 in parallel with the putter face 200. FIG. 5 illustrates a perspective view of a mallet-style putter 500 having a curved shape wherein indices are provided on a curved side 501 of the putter head 119. In this embodiment, the template may be similar to the example shown and described above or may be curved with marking scaled appropriately to enable the user to mark accurate indices on the putter head 119.

It is to be understood by one skilled in the arts that the methods and system disclosed herein can be used with any style of putter including blade-style putters, mallet-style putters, or other variations of putters and putter heads. Some putters combine elements of a mallet and blade. These putters have a larger head size, often resembling a half-mallet, with a higher moment of inertia (MOI) for added stability and forgiveness. This design can benefit golfers with various stroke types. This type of putter is known as a "Half Mallet." In this apparatus it is referred to as a "Wing".

The system and methods described herein can be used with putters having various balance systems. For example, the system and method can be used with counterbalanced, face-balanced, toe-weighted, heel weighted, center-shafted and other putters constructed having various balance configurations.

The system and methods described herein can be used with putters having various grip types, shaft types, shapes, materials, and components. For example, the grip may be a circle grip, oval grip, flat oval grip, pistol grip, flat wide grip, modified pistol grip, or triangular grip. The grip options provide diverse tactile experiences and cater to distinct golfer preferences. Further, the grip may be counterbalanced, split, forward press, non-tapered, customizable, ergonomic, corded, hybrid, wrap style, lightweight, ribbed, or oversized.

The systems and methods can be used with any grip material including silicone, rubber, leather, gel, cork, isoprene, or synthetic rubbers.

In some embodiments, the system and method disclosed herein can be used with various putter shaft technologies and configurations known in the arts. The putter shaft characteristics may include rivets, thin-shaft configurations, thick shaft configurations, and the like. Further, the shaft length may be modified to suit the golfers needs. Shaft materials can include graphite, titanium, aluminum, steel or combinations of materials. The shaft placement may be onset, offset, center set, or other known configurations can be used while remaining effective for the system and methods described in this disclosure.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety to the extent allowed by applicable law and regulations. The systems and methods described herein may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

The foregoing is provided for purposes of illustrating, explaining, and describing embodiments of this disclosure. Modifications and adaptations to these embodiments will be apparent to those skilled in the art and may be made without departing from the scope or spirit of this disclosure.

As used herein and in the appended claims, the singular forms "a", "an", and "the" include plural referents unless the context clearly dictates otherwise.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic intervening entities) and the indirect coupling of two entities (with one or more non-negligible intervening entities). Where entities are shown as being directly coupled together or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described herein. A variety of modifications and variations are possible in light of the above teachings without departing from the following claims.

What is claimed is:

1. A putter including indices for assessing a slope of a putting surface, the putter comprising:

a putter head; and a plurality of indices provided on a top surface of the putter head, wherein each of the plurality of indices is parallel to adjacent indices and wherein each of the plurality of indices is positioned along an outer edge of a boundary of the putter head extending from a heel end to a toe end to a back end, wherein each of the plurality of indices corresponds to a pre-determined slope of a putting surface; and wherein each of the plurality of indices position is calculated by the following formula:

$$(\text{length of zero mark to } X\,\%\text{ indices})=(\tan(x\,\%/100))*(\text{length of pivot point to putter head}).$$

2. The putter of claim 1, wherein the plurality of indices is applied using a semi-permanent application method.

3. The putter of claim 1, wherein the plurality of indices is applied using a permanent application method to provide a plurality of non-moveable indices on the putter head.

4. The putter of claim 1, wherein the plurality of indices is applied using a template.

5. The putter of claim 4, wherein the template comprises a main body having a plurality of linear measurement markings used to mark the putter head using an applicator, and wherein each applied by a user corresponds to the slope of the putting surface.

6. The putter of claim 5, wherein the template includes top surface and a bottom surface, wherein the top surface includes the linear measurement markings, and the bottom surface is positioned near the top surface of the putter head.

7. A system for assessing a slope of a putting surface using a putter, the system comprising:

a putter including a putter head;

a plurality of indices provided on a top surface of the putter head;

each of the plurality of indices is parallel to adjacent indices and wherein each of the plurality of the indices is positioned along an outer edge of a boundary of the putter head extending from a heel end to a toe end to a back end;

a shaft extending between the putter head and a handle configured to be held by a user to enable the putter head to rest at a fixed portion due to gravity;

a template including a main body; and a plurality of linear measurement markings provided on the main body of the template, each of the plurality of linear measurement markings provided on the main body of the template, each of the plurality of linear measurement markings to permit the application of a mark on the putter head, the mark indicating a slope of a putting surface, wherein each of the plurality of indices position is calculated by the following formula:

$$(\text{length of zero mark to } X\ \%\ \text{indices}) = (\tan(x\ \%/100)^* (\text{length of pivot point to putter head}),$$

wherein the plurality of indices includes a zero point positioned at a balance point of the putter head and established by:

standing on a 0% slope surface;

selecting an object on the putting surface;

holding the putter, via the handle, to allow the putter to hang freely by gravity from the location the putter is being held;

aligning the perspective of a dominant eye of the user vertically with the object and marking the zero point, wherein the zero point is defined as the location on the putter which is in vertical alignment with the dominant eye and the object; and utilizing a plurality of known slopes of the putter surface to mark the plurality of indices in reference to the zero point wherein each of the plurality of indices corresponds to each of the variation in the slope of the putting surface.

8. The system of claim 7, wherein the user utilizes the balance point as a reference point on the template to mark the plurality of indices using the plurality of linear markings on the template.

9. The system of claim 8, wherein the plurality of indices is fixed to the top surface.

10. The system of claim 8, wherein the plurality of indices is applied using a semi-permanent application method.

11. The system of claim 8, wherein the plurality of indices is applied using a permanent application method to provide a plurality of non-moveable indices on the putter head.

12. The system of claim 8, wherein the putter is held using a mechanical device to retain the putter above the object.

* * * * *